United States Patent [19]

Beck

[11] 4,080,510

[45] Mar. 21, 1978

[54] SILICON CARBIDE HEATER

[75] Inventor: Jacob Howard Beck, Waban, Mass.

[73] Assignee: BTU Engineering Corporation, Billerica, Mass.

[21] Appl. No.: 743,154

[22] Filed: Nov. 18, 1976

[51] Int. Cl.[2] ..... H05B 3/08; H05B 3/14

[52] U.S. Cl. ..... 13/25; 338/333; 219/552

[58] Field of Search ..... 13/20, 22, 25; 338/322, 338/331, 329, 333; 219/541, 552, 553

[56] References Cited

U.S. PATENT DOCUMENTS

| | | | |
|---|---|---|---|
| 2,271,838 | 2/1942 | Hanawalt et al. | 13/25 X |
| 2,551,341 | 5/1951 | Scheer et al. | 13/25 X |
| 2,768,277 | 10/1956 | Buck et al. | 13/25 X |
| 4,040,795 | 8/1977 | Jung | 13/25 X |

*Primary Examiner*—R. N. Envall, Jr.

*Attorney, Agent, or Firm*—Weingarten, Maxham & Schurgin

[57] ABSTRACT

A high temperature electrical resistance heater for use within a high temperature furnace. The heater is composed of an elongated tubular element having first and second tubular sections contiguous with one another, the first section being of a high resistivity silicon carbide and disposable within a furnace chamber, the second section being of a low resistivity silicon carbide and disposable external to the furnace chamber. An elongated rod of silicon carbide of low resistivity is disposed coaxially within the tubular element and in electrical connection with an end of the first tubular section. The coaxial ends of the second tubular section and of the rod include contact areas for electrical connection to an external power source. The high resistivity tubular section provides efficient heating, while the low resistivity tubular section and coaxial rod provide a conductive electrical path to the heating section while minimizing the heating thereof.

9 Claims, 3 Drawing Figures

SILICON CARBIDE HEATER

FIELD OF THE INVENTION

This invention relates in general to heating elements for high temperature electrical furnaces, and more particularly to an elongated tubular coaxial heater having contiguous tubular silicon carbide sections of high and low resistivity.

BACKGROUND OF THE INVENTION

Electrical heating elements of refractory material are known for use in very high temperature furnaces. One known type is shown in U.S. Pat. No. 3,859,501 and comprises a helical silicon carbide element having a small gap between the turns of the helix. A voltage differential exists across the gap and can be of sufficient magnitude to cause a voltage discharge especially in the presence of contaminants which condense or otherwise become disposed in the gap. The helical heater construction is, in addition, structurally weak.

Another conventional refractory heater, known as a Norton DU heater, employs two parallel rods of silicon carbide each having a high resistance portion and a low resistance portion. The high resistance portions of the parallel rods are, in operation, disposed within a furnace chamber and are connected at their ends by a connecting block of silicon carbide. The connecting block is of a size and configuration to require a relatively large opening in the furnace wall or roof for insertion of the heater into the furnace chamber. Moreover, an insulative two-hole plug must be precisely mated to the heater to retain the parallel rods within the mounting opening in the furnace. Such parallel rod construction is also subject to the deleterious effects of unequal bending stresses during furnace operation. Furthermore, the connecting block is of substantial mass, such that if the heater is suspended from the roof of a furnace chamber, the heater can be subject to pendulous movement which can cause bending stresses and cracking of the heater rods.

A coaxially constructed heater is shown in U.S. Pat. No. 3,764,718 of specific design for use in a vacuum furnace and includes a tubular resistor element and a coaxially disposed inner resistor element connected at one end to the surrounding tube. The inner and outer elements are in primary embodiment of the same resistive material which are stated to be carbon, silicon carbide, metal or metal alloy, and both inner and outer elements serve as heaters, the inner element radiating heat through the outer element which also radiates heat from its surface. In another version of this heater, the outer element is operated primarily as a conductor and as a radiant element for heat generated by one or more inner resistor elements. The heater is moveably mounted above a vacuum chamber and the outer element is adapted to be disposed within the chamber for radiation from its entire surface.

SUMMARY OF THE INVENTION

In brief, the furnace heater of this invention comprises an elongated tubular high temperature element having first and second axially extending tubular sections of silicon carbide contiguous with one another and wherein the first tubular section has a high resistivity and is adapted for disposition within the furnace chamber and wherein the second tubular section has a low resistivity and is adapted for disposition external to the furnace chamber. Disposed coaxially within the tubular element is an elongated rod of silicon carbide having low resistivity and which is electrically connected at one end to the confronting end of the first tubular section. The ends of the second tubular section and of the inner rod external to the furnace are adapted for electrical connection to an external power source.

The high resistivity tubular section operates at a substantially higher temperature than the low resistivity section and the inner rod. Thus, heat radiation occurs primarily from the high temperature tubular section disposed in the furnace chamber to achieve efficient heating. The low resistivity tubular section which is disposed external to the furnace chamber and partially within the furnace wall or roof remains at a lower temperature to thereby minimize heat losses. The inner rod, being also of low resistivity, operates at a lower temperature to minimize heating the interior of the coaxial structure.

DESCRIPTION OF THE DRAWINGS

The invention will be more fully understood from the following detailed description, taken in conjunction with the accompanying drawings in which.

DESCRIPTION OF THE PREFERRED EMBODIMENT

Figure 1:
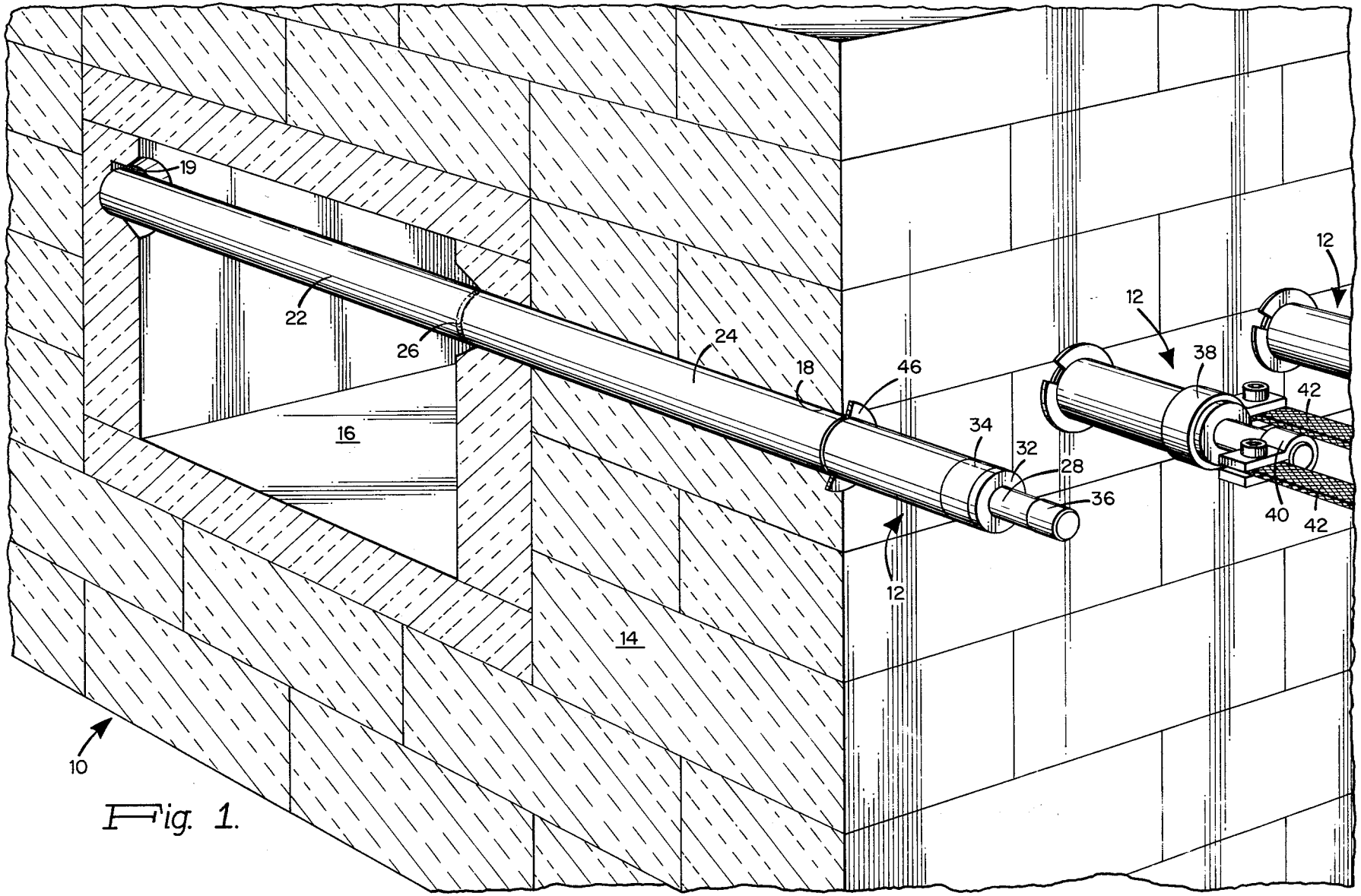
FIG. 1 is a cutaway pictorial view of a furnace showing a heater constructed according to the present invention.

With reference now to the drawings and more particularly to FIG. 1, there is shown a furnace 10 incorporating an electrical resistance heater 12 in accordance with the principles of the present invention. Typically, the furnace is assembled of appropriate firebrick 14 which enclosed a heating chamber 16 wherein a product to be processed is disposed. One or more electrical resistance heaters 12 are inserted into the furnace chamber through respective mounting ports 18 in the furnace structure. In the illustrated embodiment a plurality of heaters 12 are spaced along the furnace, each being horizontally disposed through a respective port 18 in the furnace wall. The inner end of each heater 12 can be disposed within an opening 19 in the opposite wall of the furnace chamber to provide further support of the heater to minimize or prevent sagging under high operating temperatures. The heater of the present invention can be installed in other positions, such as vertically through the roof of the furnace, and the heater mounting shown is only exemplary and is not to limit the invention.

Figure 2:
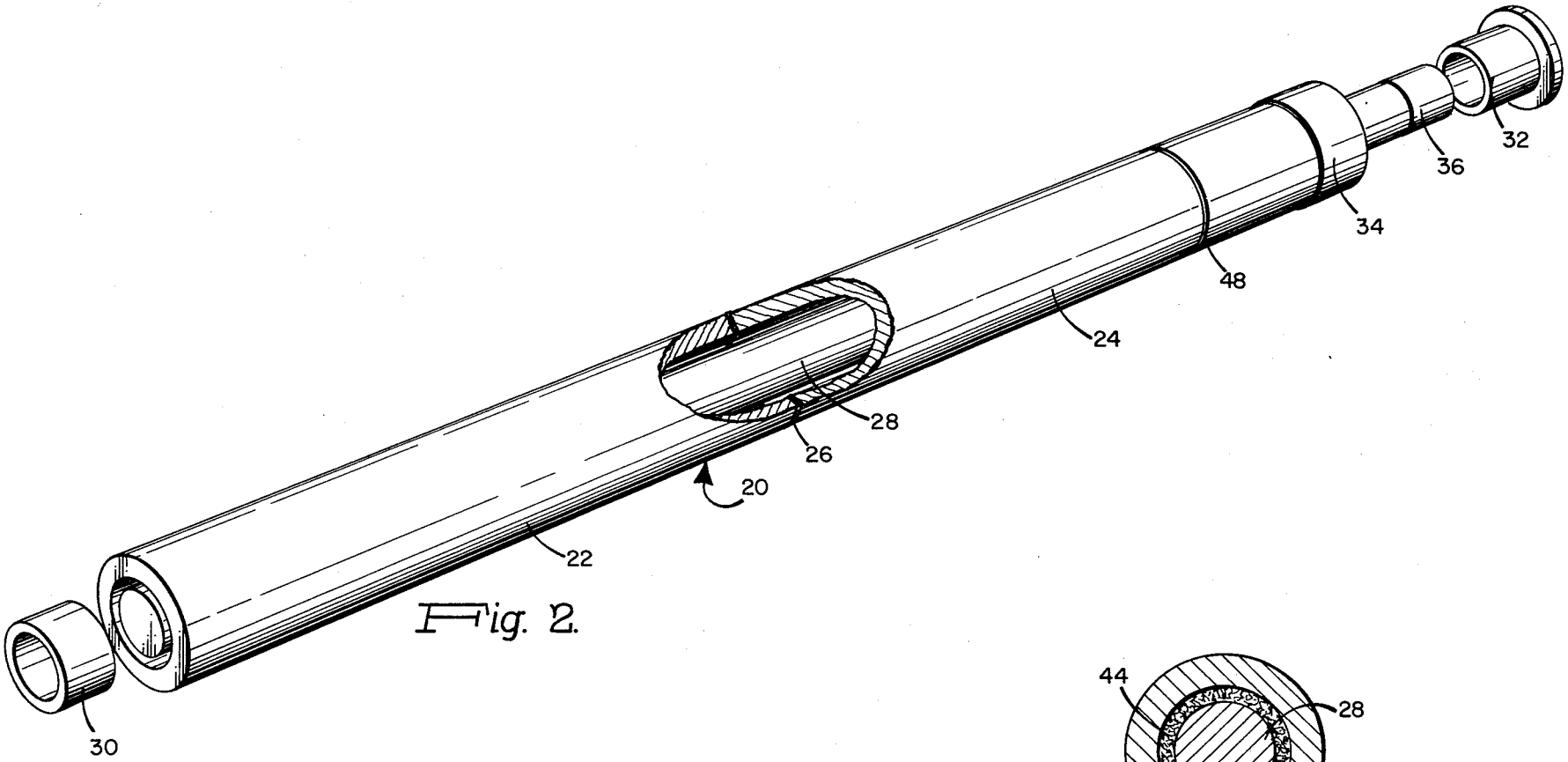
FIG. 2 is a cutaway exploded pictorial view of the heater of FIG. 1.

The heater 12 is more fully shown in FIG. 2 and comprises an elongated tubular element 20 having a first axially extending tubular section 22 of silicon carbide having a high resistivity, and a second axially extending tubular section 24 contiguous and joined to section 22 and of silicon carbide having a low resistivity. Section 22, which in operation is disposed within furnace chamber 16, is of relatively high resistivity to provide efficient heating. Section 24 is of relatively low resistivity to provide a conductive electrical path to the heating section 22 while minimizing the heating of section 24 which in operation is disposed external to chamber 16 and partially within the furance wall. The sections 22 and 24 are joined at their confronting ends by a weld 26. The high temperature section 22 is of a length to extend across substantially the entire width of the furnace chamber.

An elongated rod 28 of silicon carbide of low resistivity is disposed coaxially within sections 22 and 24 and coextensive therewith, with one end of rod 28 extending beyond section 24. The other end of rod 24 is joined to the confronting end of high temperature section 22 by a silicon carbide member such as a preformed weld ring 30, also preferably of low resistivity, disposed between the confronting surfaces of section 22 and rod 28 and welded thereto. The rod 28 is by means of weld ring 30 electrically connected to one end of high temperature section 22, the opposite end of section 22 being electrically connected to section 24. The high temperature heater section is therefore electrically connected to a power source by the lower temperature section 24 and inner rod 28. The inner end of section 22 disposable within the furnace chamber is sealed by weld ring 30 to prevent the entry of gas or other contaminants from the furnace chamber to the interior of tubular element 20. Contaminants cannot build up between conductors, as in conventional refractory heaters, and short-circuiting by reason of such build-up cannot occur.

An electrically insulative flanged ring 32, preferably formed of alumina or other suitable ceramic, is disposed in the outer end of section 24 to maintain the coaxial position of rod 28 within sections 22 and 24 and to isolate the heater interior from the external environment.

A metallized band 34 is flame-sprayed or otherwise applied to the outer end of section 24, while a similar metallized band 36 is provided around the outer end of rod 28. These bands 34 and 36 are preferably formed of aluminum and serve as contact areas for electrical connection to an external power source. As shown in FIG. 1 a conductive clamp 38 is secured to contact area 34, and a clamp 40 is secured to contact area 36. The clamps are connected such as by braided wire straps 42 to the power source in well-known manner. A retaining ring 46 can be provided in cooperation with a circumferential groove 48 near the terminal end of section 24 for limiting the insertion length of the heater in the furnace or for installing the heater through the roof.

Figure 3:
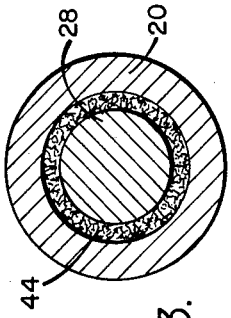
FIG. 3 is a cross-sectional view of an alternative embodiment of the heater of FIGS. 1 and 2.

Referring to FIG. 3, an alternative embodiment is shown in which a packed powder filler 44 of alumina or magnesia can be provided in the annular space between rod 28 and sections 22 and 24 to provide further support for rod 28 within sections 22 and 24. The filler material is non-reactive with the silicon carbide at the high operating temperatures of the heater and prevents deformation or sagging of rod 28, which can occur especially for relatively long heater lengths.

In operation with the heater installed in a furnace as in FIG. 1, electrical energy from a power source is applied to the contact areas of section 24 and rod 28 such as by clamps 38 and 40, to raise the heater to operating temperature. The high resistivity section 22 disposed in the furnace chamber is at a higher temperature than that of section 24 and rod 28 of lower resistivity. Radiation occurs primarily from the section 22 for efficient heating of the chamber. When energized, the high temperature section 22 typically operates at 1550° C, while the terminal ends of section 24 and rod 28 typically operate at 260° C. The resistivity of high temperature section 22 is up to 20 times that of section 24 and rod 28 to provide maximum radiation from only the high temperature section 22 within the furnace chamber.

The invention is not to be limited by what has been particularly shown and described, except as indicated in the appended claims.

What is claimed is:

1. A high temperature electrical resistance heater adapted for use within a high temperature furnace comprising:

an elongated tubular element including:

a first axially extending tubular section of silicon carbide having a high resistivity and adapted for disposition within a furnace chamber;

a second axially extending tubular section contiguous with and electrically and thermally joined to said first tubular section and of silicon carbide having a low resistivity and adapted for disposition external to the furnace chamber;

an elongated rod of silicon carbide of a low resistivity disposed coaxially within and substantially coextensive with said tubular element;

a silicon carbide member electrically connecting the end of said first tubular section to the confronting end of said rod; and means for electrically connecting the end of said second tubular section and the confronting end of said rod to a power source.

2. A high temperature heater according to claim 1 wherein said silicon carbide member electrically connecting the end of said first tubular section and the confronting end of said rod includes:

a preformed silicon carbide weld ring of low resistivity disposed about the circumference of said rod and within said first tubular section, said weld ring radially extending from the surface of said rod to said first tubular section to provide coaxial spacing of said rod and said first tubular element, sealed end engagement of said rod to said first tubular section, and electrical connection therebetween.

3. A high temperature heater according to claim 1 wherein said power source connecting means includes a coating of electrically conductive metal around the circumferential surface of said rod and said second section.

4. A high temperature heater according to claim 1 including:

a refractory insulative flanged ring disposed in the end of said second tubular element and around the confronting portion of said rod to maintain the coaxial position of the rod within the first and second tubular sections.

5. A high temperature heater according to claim 1 wherein the resistivity ratio of the silicon carbide of said first section to the silicon carbide of said second section and said rod is about twenty to one.

6. A high temperature heater according to claim 1 including a refractory insulative packed powder disposed between said rod and said element and along the length thereof to provide continuous coaxial alignment of said rod and said element.

7. A high temperature heater according to claim 6 wherein said refractory insulative packed powder is alumina.

8. A high temperature electrical resistance heater adapted for use within a high temperature furnace comprising:

an elongated tubular element including:

a first axially extending tubular section of silicon carbide having a high resistivity and of a length to be substantially coextensive with the dimension of the furnace chamber along which the heater is disposed;

a second axially extending tubular section of silicon carbide having a low resistivity, said second section being electrically and thermally joined to said first section along a common axis, said second section being of a length to extend through the insulative structure of the furnace and to extend outwardly therefrom;

an elongated rod of silicon carbide having a low resistivity disposed coaxially within said tubular element and extending outwardly from the end thereof external to the furnace chamber;

a low resistivity silicon carbide weld ring disposed between the confronting coaxial ends of said first section and said rod and welded thereto to provide electrical connection thereof and sealing of that end of said heater;

a flanged ring of refractory insulative material disposed between the confronting coaxial surfaces of said second section and said rod to maintain the coaxial position of said rod within said tubular element;

a band of electrically conductive material disposed around the outer circumferential surface of said second section at the external end thereof to provide a first contact area for electrical connection to a power source; and a band of electrically conductive material disposed around the circumferential surface of said rod at the external end thereof to provide a second contact area for electrical connection to a power source.

9. A high temperature heater according to claim 8 including:

a circumferential groove in the outer surface of said second section near the external end thereof; and retaining means cooperative with said groove for limiting the insertion length of said tubular element in the furnace.

* * * * *